US010164327B2

(12) United States Patent
Nakada et al.

(10) Patent No.: US 10,164,327 B2
(45) Date of Patent: Dec. 25, 2018

(54) ANTENNA DEVICE

(71) Applicant: YOKOWO CO., LTD., Tokyo (JP)

(72) Inventors: Noriyoshi Nakada, Gunma (JP); Atsushi Ubukata, Gunma (JP)

(73) Assignee: YOKOWO CO., LTD., Tokyo (JP)

( * ) Notice: Subject to any disclaimer, the term of this patent is extended or adjusted under 35 U.S.C. 154(b) by 142 days.

(21) Appl. No.: 15/116,029

(22) PCT Filed: Jan. 20, 2015

(86) PCT No.: PCT/JP2015/051361
§ 371 (c)(1),
(2) Date: Aug. 2, 2016

(87) PCT Pub. No.: WO2015/118939
PCT Pub. Date: Aug. 13, 2015

(65) Prior Publication Data

US 2017/0179584 A1 Jun. 22, 2017

(30) Foreign Application Priority Data

Feb. 10, 2014 (JP) ..... 2014-023648

(51) Int. Cl.
*H01Q 1/32* (2006.01)
*H01Q 1/12* (2006.01)
(Continued)

(52) U.S. Cl.
CPC ..... *H01Q 1/3275* (2013.01); *H01Q 1/1214* (2013.01); *H01Q 1/362* (2013.01); *H01Q 1/42* (2013.01)

(58) Field of Classification Search
CPC .... H01Q 1/3275; H01Q 1/1214; H01Q 1/362; H01Q 1/42; H01Q 1/422
See application file for complete search history.

(56) References Cited

U.S. PATENT DOCUMENTS 8,134,520 B2 3/2012 Noro
8,497,807 B2 7/2013 Wakui et al.
(Continued)

FOREIGN PATENT DOCUMENTS

EP 0747993 A2 12/1996
EP 0862239 B 2/2005
(Continued)

OTHER PUBLICATIONS

International Search Report for corresponding PCT Application No. PCT/JP2015/051361, 4 pages, dated Mar. 17, 2015.
(Continued)

*Primary Examiner* — Robert Karacsony
(74) *Attorney, Agent, or Firm* — Matthew B. Dernier, Esq.

(57) ABSTRACT

Provided is an antenna device capable of simplifying a structure while preventing degradation of antenna performance even with an upright type double-case structure. An antenna device having a double-case structure includes an inner case inside of which a housing space is formed so as to house a coil element and the like therein, the inner case being covered with an outer case. An antenna element is provided between an outer surface of the inner case and an inner surface of the outer case. The antenna element is electrically connected to the coil element provided in the housing space while keeping water-tightness of the housing space.

17 Claims, 8 Drawing Sheets

(51) Int. Cl.
*H01Q 1/36* (2006.01)
*H01Q 1/42* (2006.01)

(56) References Cited

U.S. PATENT DOCUMENTS

| | | | | |
|---|---|---|---|---|
| 8,514,137 | B2 | 8/2013 | Tateno | |
| 2010/0099370 | A1 | 4/2010 | Nichols | |
| 2010/0265147 | A1 | 10/2010 | Wakui | |
| 2011/0221640 | A1 | 9/2011 | Huber | |
| 2013/0265208 | A1 | 10/2013 | Sawaya | |
| 2014/0225789 | A1 | 8/2014 | Katayama | |
| 2016/0104932 | A1* | 4/2016 | Aminzadeh | H01Q 1/3275 343/872 |

FOREIGN PATENT DOCUMENTS

| | | | |
|---|---|---|---|
| EP | 3093920 | A1 | 11/2016 |
| JP | 06041219 | U | 5/1994 |
| JP | 11-274824 | A | 10/1999 |
| JP | 11-274832 | A | 10/1999 |
| JP | 3513070 | B | 3/2004 |
| JP | 2010021856 | A | 1/2010 |
| JP | 2010182602 | A | 8/2010 |
| JP | 2012085044 | A | 4/2012 |
| JP | 2013098661 | A | 5/2013 |
| JP | 2013229813 | A | 11/2013 |
| WO | 2010114336 | A2 | 7/2010 |
| WO | 2013161520 | A1 | 10/2013 |
| WO | WO 2013/161520 | A1 * | 10/2013 |
| WO | 2014204494 | A1 | 12/2017 |

OTHER PUBLICATIONS

Office Action for corresponding EP Application No. GB1613323.3, 3 pages, dated Oct. 9, 2017.
European Search Report for corresponding EP Application No. 15746706.9, 8 pages, dated Aug. 10, 2017.
Third Party Observation of corresponding application EP150746706.9, 7 pages, dated Sep. 20, 2018.

* cited by examiner

ANTENNA DEVICE

TECHNICAL FIELD

The present invention relates to an antenna device having a double-case structure, which is to be installed upright on a vehicle roof.

BACKGROUND ART

A case of an antenna device installed on a vehicle roof is painted in a color so as to match with a body color of a vehicle in many cases. Therefore, vehicle manufacturers have to store antenna devices for respective colors in a vehicle assembly line stock, resulting in taking up a space for stock. As a countermeasure against it, double-case structure has hitherto been attempted to be provided to the antenna device. For example, an antenna unit, which is disclosed in Patent Literature 1, includes an antenna element housed water-tightly in a space formed by a base and an inner case, and is configured to cover the inner case with an outer case having a color matched with a body color.

On the other hand, in view of design, there has recently been proposed an antenna device including a case formed in a streamline shape called "shark fin". However, under regulations on projections from vehicles, a height of the antenna device projecting from the vehicle roof is limited to about 70 mm or smaller. In the antenna device configured to receive AM/FM bands, the antenna element is required to be arranged at a position as high as possible so as to ensure electrical performance. Thus, under a condition in which the height is limited to about 70 mm or smaller, the electrical performance cannot be sufficiently ensured. As a measure for solving the problem described above, for example, a small-height type antenna device disclosed in Patent Literature 2 is designed to set an area of the antenna element to be housed within a small space as large as possible, and to arrange the antenna element at a high position. Specifically, after an antenna board with an antenna pattern formed thereon is installed upright on the base, a top portion is arranged to extend across the antenna board so that the top portion and the antenna pattern may form a complex type antenna element.

CITATION LIST PATENT LITERATURE

[PTL 1] 2012-085044 A, [PTL 2] 2010-021856 A

SUMMARY OF INVENTION

Technical Problem

When the small-height type antenna element disclosed in Patent Literature 2 is configured to have the double-case structure as in the case of the antenna device disclosed in Patent Literature 1, the antenna element is housed inside the inner case. Therefore, as compared to a single case, a housing space is correspondingly reduced because of the double structure. No problem occurs when a patch antenna is designed to have a small height and a small size as described in Patent Literature 1. In the antenna device including the antenna element that is required to be arranged at a high position so as to ensure the electrical performance required for AM/FM band reception as described in Patent Literature 2. However, a position at which the antenna element is arranged becomes a lower position. Further, the area thereof is reduced. Thus, degradation of antenna performance is inevitable.

Further, the structure configured to support the antenna element becomes more complex. Thus, there is another problem in that manufacture cost cannot be reduced.

The present invention has an object to provide an antenna device capable of simplifying a structure while preventing the degradation of the antenna performance even with an upright-type double-case structure.

Solution to Problem

According to one embodiment of the present disclosure, there is provided an antenna device to be installed on a predetermined portion of a vehicle body, including: an inner case having a three-dimensional shape, configured to form a housing space so as to house an electronic component therein, and an outer case configured to cover the inner case. A height from the vehicle body to a highest portion of the outer case may be smaller than 70 mm.

An antenna element is provided between an outer surface of the inner case and an inner surface of the outer case. The antenna element is electrically connected to the electronic component housed in the housing space while maintaining water-tightness of the housing space inside the inner case.

The antenna element is, for example, formed in an approximately planar shape along a shape of the outer surface of the inner case or the inner surface of the outer case. A watertight connecting member is provided so as to electrically connect the antenna element to the electronic component housed in the housing space while maintaining the water-tightness of the housing space inside the inner case. The watertight connecting member includes an outer terminal exposed on the outer surface of the inner case and an inner terminal conductive with the outer terminal, which is exposed on the inner surface of the inner case while maintaining the water-tightness of the housing space inside the inner case. The watertight connecting member is embedded in, for example, a case main body of the inner case.

Advantageous Effects of Invention

The antenna device according to the present disclosure includes the antenna element provided between the outer surface of the inner case and the outer case. The antenna element is electrically connected to the electronic component housed in the housing space while maintaining the water-tightness of the housing space inside the inner case. Therefore, even with the double-case structure having a restriction on height, cost can be reduced while preventing the antenna performance from being lowered in a case of the antenna performance with a single case structure in the same size.

DESCRIPTION OF EMBODIMENTS

Embodiments of the present invention are described in the following with reference to the attached drawings.

First Embodiment

<Entire Configuration>

Figure 1:
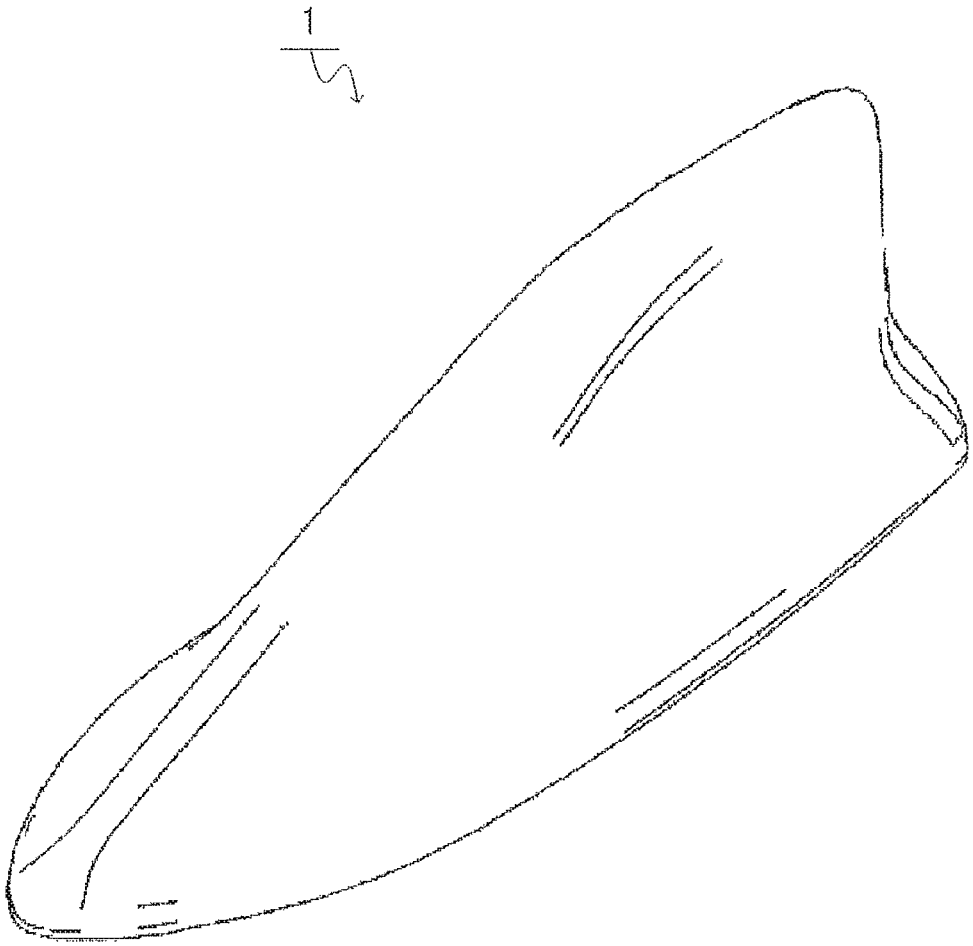
FIG. 1 is an external perspective view of an antenna device according to a first embodiment of the present invention.
Figure 2:
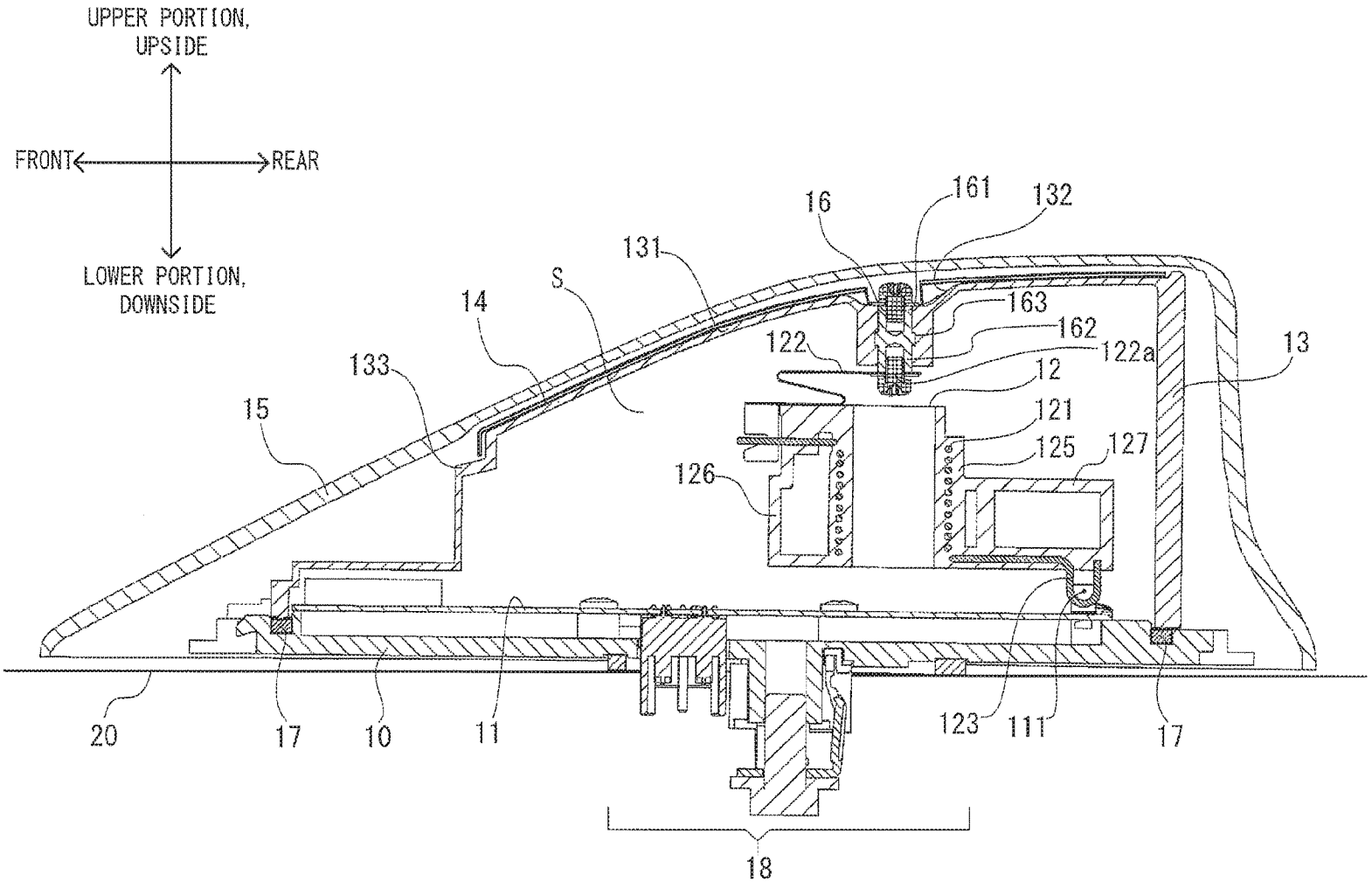
FIG. 2 is an explanatory view of a sectional structure of the antenna device according to the first embodiment.
Figure 3:
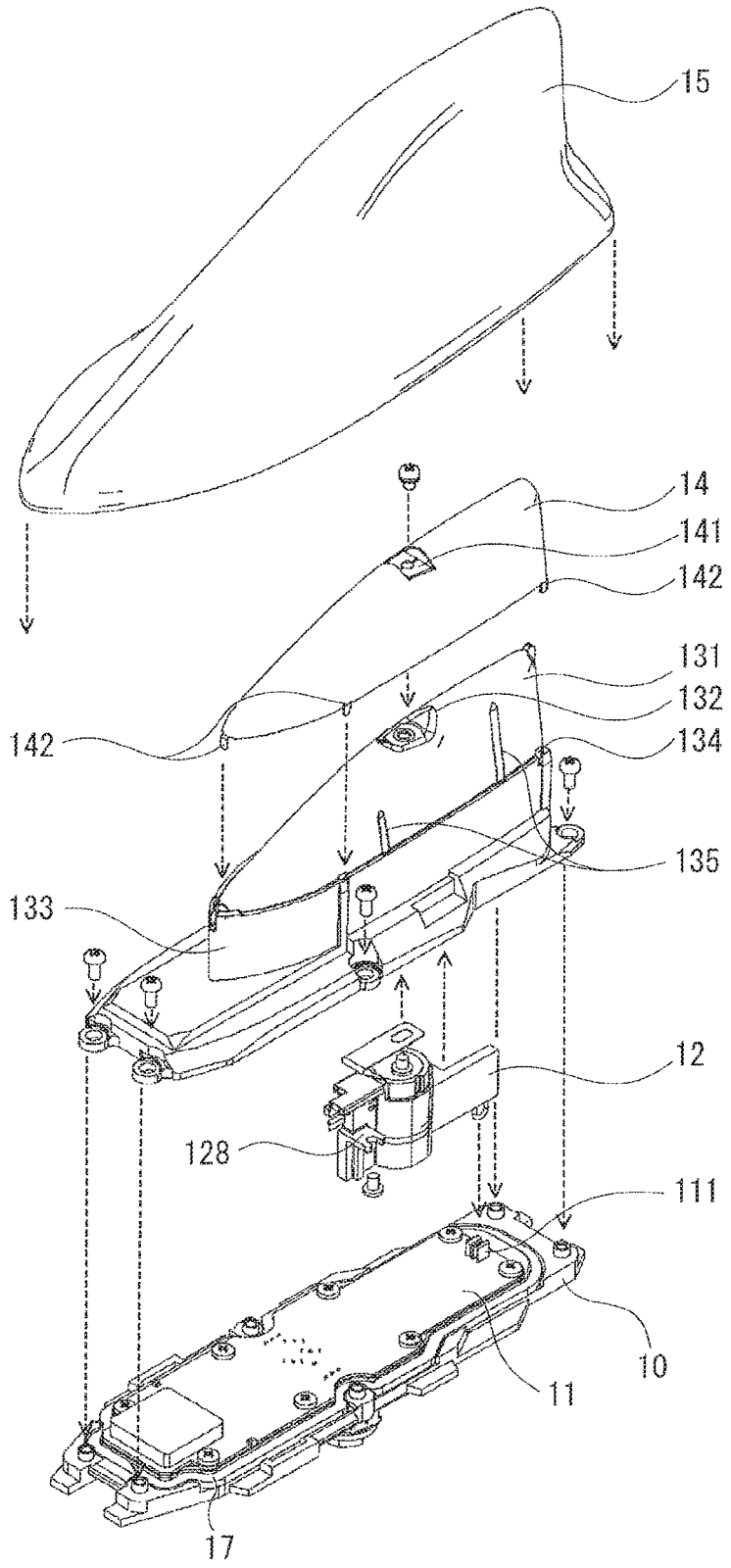
FIG. 3 is an exploded perspective view of the antenna device according to the first embodiment.

FIG. 1 is an external perspective view of an antenna device according to a first embodiment of the present invention. FIG. 2 is an explanatory view of a sectional structure of the antenna device. FIG. 3 is an exploded perspective view of the antenna device.

An antenna device 1 according to this embodiment is an antenna device mainly configured to receive AM and FM bands, and has a double-case structure including a base 10, a circuit board 11 on which an electronic circuit such as an amplifier is mounted, a coil element 12, an inner case 13 mounted to the base 10 with water-tightness, an antenna element 14, and an outer case 15 configured to cover the inner case 13.

In this specification, assuming that a mounted state of the antenna device 1 is as illustrated in FIG. 2, a description is given defining the left in FIG. 2 as "front", the right in FIG. 2 as "rear", the upper side in FIG. 2 as "upper portion" or "upside", and the lower side in FIG. 2 as "lower portion" or "downside" for convenience.

The outer case 15 has a three-dimensional shape that projects upward from a body roof 20 corresponding to an example of a mounted surface to have a height within 70 mm. For example, the outer case 15 is formed to have a shark fin-like shape with the smallest height at an upper front end and the largest height at an upper rear end. The outer case 15 is a radiowave transmitting member made of, for example, a resin, and is painted so as to match a vehicle body color.

The inner case 13 is hollow, and has a top portion 131 having an approximately similar shape to a shape of an inner surface of the outer case 15, a dent portion 132 formed on a part of the top portion 131, and a side wall portion 133 in connection with the top portion 131. The inner case 13 has an edge portion mounted to the base 10 through an elastic pad 17 therebetween. As a result, a housing space S for housing an electronic component and the like therein is formed between an upper surface of the base 10 and an inner portion of the inner case 13. The inner case 13 is made of, for example, a resin. The top portion 131 of the inner case 13 is formed to extend from an upper end of the inner case 13 to a predetermined height position. The "predetermined height position" is a position at which the antenna element 14 provided on the top portion 131, which is described later can ensure antenna characteristics. Further, hole portions 134 for housing tongue pieces 142 of the antenna element 14, which are described later, are formed in a base portion of the top portion 131. Further, on each of both side surfaces of the top portion 131, two projecting portions 135 extending upward from a lower end are formed.

The base 10 serves as a base for the inner case 13 and the outer case 15 and also serves as a mount base for the vehicle body roof 20, and is formed by aluminum die casting, zinc die casting, or the like. In addition to a dent for housing the above-mentioned elastic pad 17 therein, a connector mechanism 18 that projects downward beyond the vehicle body roof 20 and is configured to electrically connect the electronic circuit mounted on the circuit board 11 and an electronic apparatus provided inside the vehicle body to each other is provided to the base 10.

The circuit board 11 includes a conductive terminal (not shown) conductive with the electronic circuit. The conductive terminal and an electronic component provided on the board are electrically connected. On a surface of the circuit board 11, which is closer to the inner case 13, a terminal 111 having conductivity is provided. The terminal 111 is a kind of fitting having a bifurcated portion, and is configured to electrically connect a U-shaped piece 123 of the coil element 12, which is described later, and the conductive terminal of the circuit board 11 to each other while elastically supporting the U-shaped piece 123. The bifurcated portion is formed by bending a band-like metal plate into an M-like shape so as to form two projections (bifurcation). Both ends of the bifurcated portion that forms the M-like shape are inserted into the conductive terminal of the circuit board 11 so as to be fixed thereto. In this manner, the conductive terminal of the circuit board 11 and the terminal 111 are electrically connected.

The coil element 12 includes a helical coil 121 having a cylindrical shape for impedance adjustment, a joint plate 122 having an elongated plate-like shape, configured to be conductive with an end portion of the helical coil 121, and the U-shaped piece 123 conductive with another end portion of the helical coil 121. Further, the coil element 12 is formed by molding the helical coil 121, a base portion of the joint plate 122, and a base portion of the U-shaped piece 123 with a resin.

A portion formed by molding the helical coil 121 is referred to as "coil supporting portion 125", a portion formed by molding the base portion of the joint plate 122 is referred to as "front supporting portion 126", and a portion formed by molding the base portion of the U-shaped piece 123 is referred to as "rear supporting portion 127".

The coil supporting portion 125 is also formed in a cylindrical shape. A mount hole 128 for fixing the coil element 12 to a predetermined portion of an inner wall of the inner case 13 is formed in each of the front supporting portion 126 and the rear supporting portion 127.

Although the coil supporting portion 125, the front supporting portion 126, and the rear supporting portion 127 are generally formed integrally, the coil supporting portion 125, the front supporting portion 126, and the rear supporting portion 127 may be assembled after being individually formed.

The joint plate 122 is formed by, for example, bending a metal plate having both end portions into an approximately Z-like shape and forming a through hole **122*a* in one end portion thereof. The through hole 122*a* is formed at a position approximately aligned with a central axis of a hollow portion of the coil supporting portion 125**.

The U-shaped piece 123 is inserted into a central portion of the bifurcated portion of the terminal 111 as described above so as to be elastically sandwiched therebetween.

The antenna element 14 is formed in an approximately similar shape to a shape of the surface of the top portion 131 except for a rear surface, and is arranged on the top portion 131 of the inner case 13 so as to be present between the inner case 13 and the inner surface of the outer case 15. Then, the antenna element 14 is electrically connected to the coil element 12 while maintaining water-tightness of the housing space S by a watertight connecting member 16. A specific structure of the watertight connecting member 16 that enables the connection as described above is described later.

The antenna element 14 is formed of stainless steel (SUS) so as to suppress corrosion. In a simple fashion, by bending the SUS in a plate-like shape having a thickness of about 0.4 mm to fit an outer shape of the top portion 131, a sectional shape is formed as an approximately inverted U-like shape. However, the antenna element 14 may be constructed by forming linear SUS into a net-like shape without being limited to the example described above. As already described above, it is desirable that a height of the antenna element 14 from the vehicle roof 20 be as high as possible so as to prevent degradation of antenna performance. In a case of this embodiment, a height from the vehicle roof 20 to the highest portion of the antenna element 14 is 65 mm.

A through hole 141 for electrical connection to the watertight connecting portion 16 is also formed in the antenna element 14. From an edge of the antenna element 14, the five tongues pieces 142 project downward. The tongue pieces 142 are inserted into the hole portions 134 formed at corresponding positions of the inner case 13. The tongue portions 142 are provided to prevent the antenna element 14 from being removed from the inner case so as to bring the projecting portions 135 of the top portion 131 into elastic contact with an inner side surface of the antenna element.

The watertight connecting member 16 includes a conductive member having a cylindrical shape with a partition, which has a common partition portion and a pair of opening portions that are open in directions opposite to each other, in which the partition portion separates the housing space S and a space in the periphery of the outer surface of the inner case 13 from each other. A thread groove is engraved on an inner wall of each of the pair of opening portions. One of the above-mentioned opening portions becomes an outer terminal 161 that is exposed on the outer surface of the inner case 13. Another of the opening portions becomes an inner terminal 162 that is exposed in the housing space S so as to be conductive with the outer terminal 161 while maintaining the water-tightness of the housing space S.

The outer terminal 161 also serves as a mounting mechanism for the antenna element 14. Specifically, a male screw made of a metal is threadably fitted through the through hole 141 of the antenna element 14 so that the antenna element 14 is sandwiched between a head portion of the male screw and the outer terminal 161, thereby enabling electrical connection between the antenna element 14 and the watertight connecting member 16.

Similarly, the inner terminal 162 also serves as a mounting mechanism for the helical coil 121. Specifically, a male screw made of a metal is threadably fitted through the through hole 122*a* of the joint plate 122 of the coil element 12 so that the joint plate 122 conductive with the helical coil 121 is sandwiched between a top portion of the male screw and the inner terminal 162, thereby enabling electrical connection between the watertight connecting member 16 and the helical coil 121.

An outer peripheral portion of the partition portion, which is located at an approximately intermediate position between the both opening portions of the watertight connecting member 16, is a ridge 163 having a larger diameter than that of the pair of opening portions. The watertight connecting member 16 having the structure described above is embedded in a case main body by insert molding so that each of the opening portions is exposed, for example, at the time of formation of the inner case 13. The ridge 163 prevents the embedded watertight connecting member 16 from being removed from the inner case 13 and further ensures the water-tightness of the housing space S.

Assembly Procedure

Assembly of the antenna device 1 is first started with portions excluding the outer case 15.

A worker first mounts the terminal 111 onto the circuit board 11, and then mounts the circuit board 11 onto the base 10. Further, the antenna element 14 is mounted onto the top portion 131 of the inner case 13. The antenna element 14 is mounted onto the top portion 131 by inserting the five tongue pieces 142 of the antenna element 14 into the hole portions 134 of the inner case 13 and then threadably fitting the male screw into the outer terminal 161 of the watertight connecting member 16 through the through hole 141. At this time, the projecting portions 135 of the top portion 131 come into elastic contact with the inner side surface of the antenna element 14. Therefore, even when the vehicle body (vehicle roof) and the antenna device 1 oscillate due to travel of the vehicle, the antenna element 14 is not separated from the inner case 13.

Figure 4A:
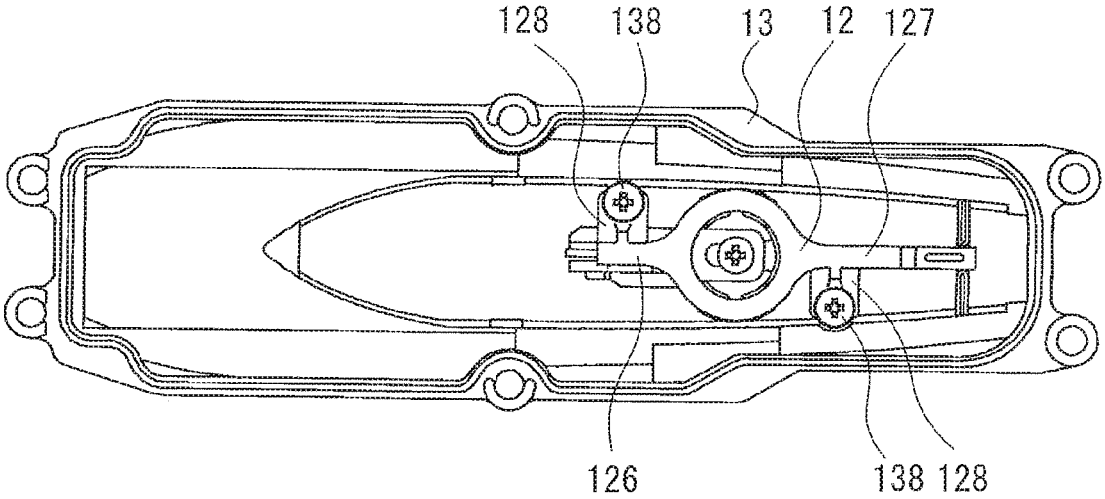
FIG. 4A is an explanatory view of a back surface of an inner case, for illustrating a state in which a coil element is mounted.
Figure 4B:
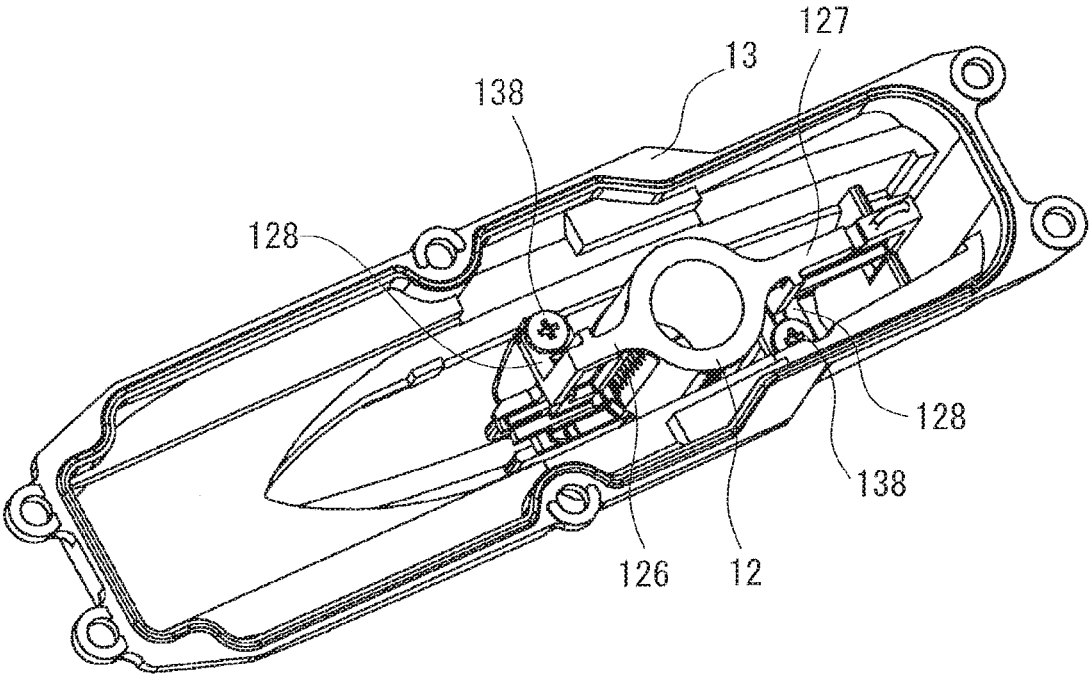
FIG. 4B is an external perspective view thereof.

Next, as illustrated in FIGS. 4A and 4B, through the pair of mount holes 128 formed in the front supporting portion 126 and the rear supporting portion 127, the coil element 12 is fixed by screwing to a predetermined portion of the inner wall of the inner case 13. Then, the male screw is threadably fitted into the inner terminal 162 of the watertight connecting member 16 through the through hole 122*a* of the joint plate 122, which is visible through the hollow portion of the coil supporting portion 125. Thereafter, as illustrated in FIG. 3, the inner case 13 comes into contact with the elastic pad 17 provided on the base 10, and is fixed by screwing. When the inner case 13 is mounted onto the base 10, the U-shaped piece 123 in the rear supporting portion 127 of the coil element 12 is inserted into the terminal 111 provided on the circuit board 11 so as to be sandwiched therein.

The antenna element 14 may be mounted onto the inner case 13 in a final step.

Figure 5:
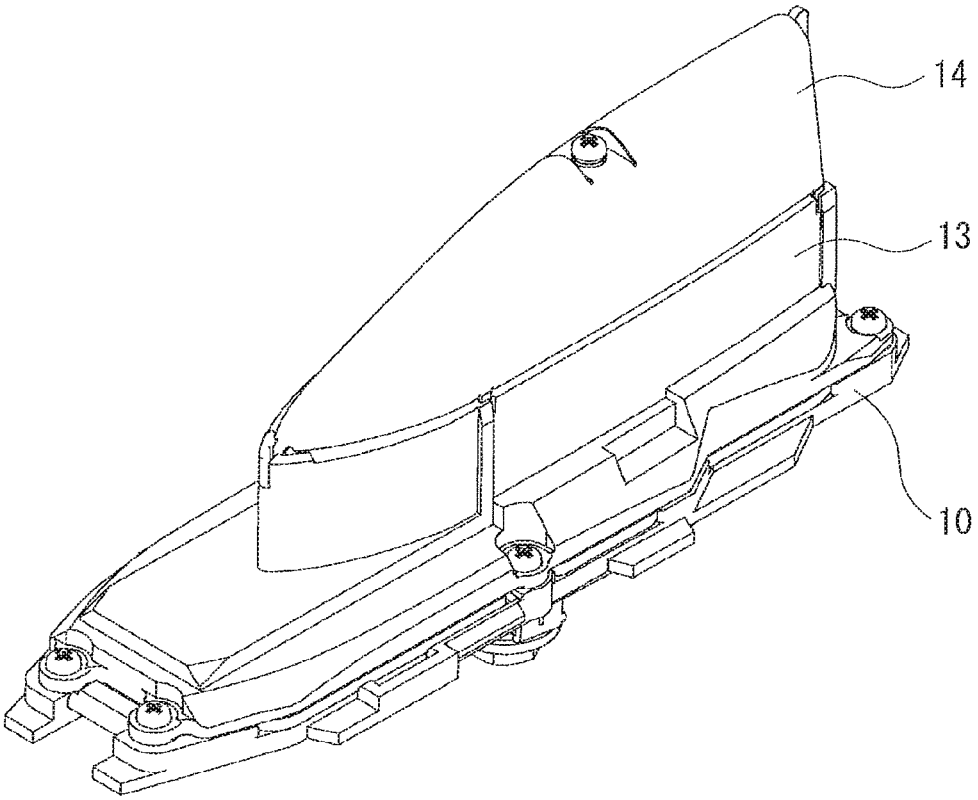
FIG. 5 is an external perspective view of an assembly before an outer case is mounted.

FIG. 5 is an external perspective view of the assembly assembled in the above-mentioned manner. The assembly is covered with the outer case 15 to complete the antenna device 1. The outer case and the assembly are assembled by engaging a claw (not shown) provided to the outer case with a predetermined portion of the base 10.

In the assembly illustrated in FIG. 5, the base 10 and the inner case 13 are electrically connected to the antenna element 14, the helical coil 121, and the like through the watertight connecting member 16 in a state in which the base 10 and the inner case 13 are elastically joined together through the elastic pad 17 to keep the water-tightness. Therefore, even when water-tightness between the outer case 15 and the assembly is not sufficient, the electronic circuit provided in the housing space S is not affected. Thus, manufacture steps are extremely simplified.

[Comparison of Characteristics]

For comparison, an experimental antenna device in which the antenna element 14 having the same area was assembled inside the inner case 13 while changing a shape was constructed. A sensitivity of the thus obtained antenna device and a sensitivity in a case where the antenna element 14 was arranged on an outer side of the inner case 13, specifically, on the top portion 131 as in the case of the antenna device 1 of this embodiment were measured. An experiment was conducted after a hole was formed in a metal plate of about 1 m square and the antenna device was mounted on the metal plate in place of the vehicle roof 20. In the case of the experimental antenna device, a height from the metal plate to the highest portion of the antenna element was about 64 mm (65 mm in the case of the antenna device 1 of this embodiment). For a frequency, 76 MHz to 90 MHz was used as an FM band, and 594 kHz was used as an AM band.

Figure 6:
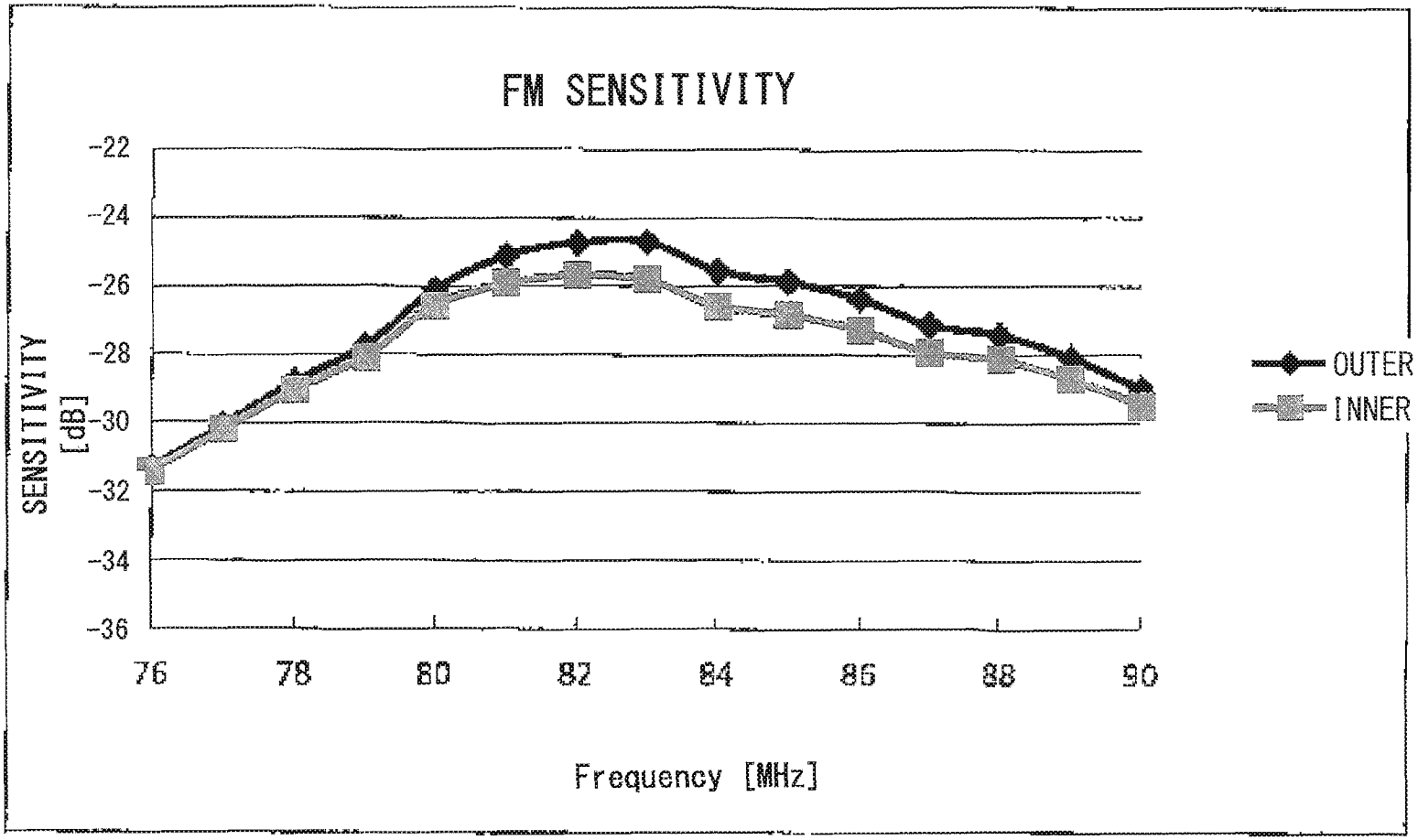
FIG. 6 is a graph for comparing sensitivity characteristics in an FM band.
Figure 7:
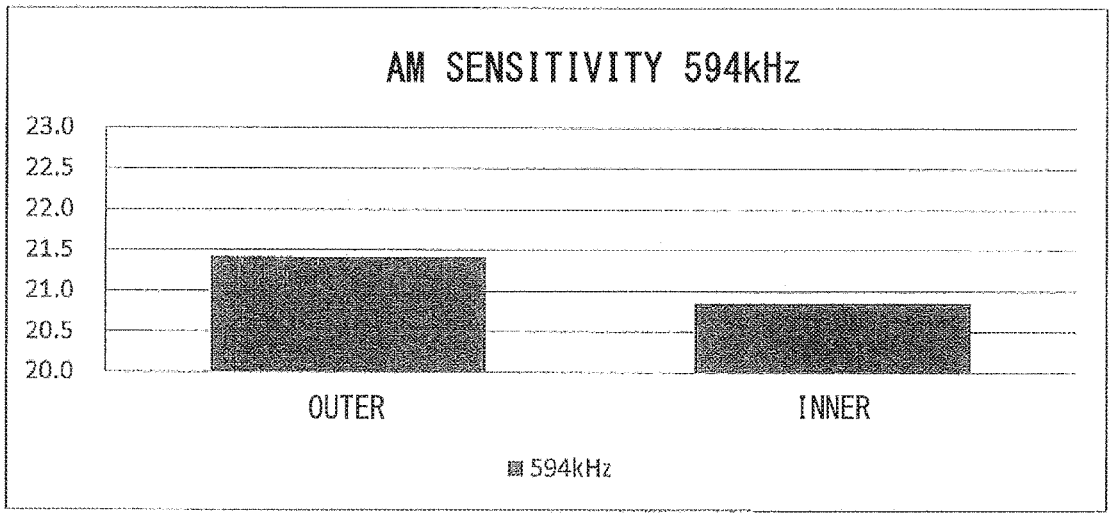
FIG. 7 is a graph for comparing sensitivity characteristics in an AM band.

FIG. 6 is a graph for comparison of sensitivity characteristics in the FM band, and has a horizontal axis indicating the frequency and a vertical axis indicating the sensitivity (dB). FIG. 7 is a graph for comparison of sensitivity characteristics in the AM band, and has a vertical axis indicating the sensitivity (dB). In each of the graphs, "outer" indicates a sensitivity change in a case where the antenna element 14 is arranged on the outer side of the inner case 13, and "inner" indicates a sensitivity change in a case where the antenna element 14 is arranged on an inner side thereof.

In each of the cases, by arranging the antenna element 14 on the top portion 131 of the inner case 13 as in this embodiment, improvement of the sensitivity was observed.

As described above, the antenna element 14 is arranged on the top portion 131 of the inner case 13 in the antenna device 1 of this embodiment. Thus, even with the double-case structure, an area and a height equal to those of an antenna element of an antenna device having a single-case structure with the same shape and size can be ensured. Therefore, the degradation of the antenna performance can be prevented when the double-case structure is provided.

Further, the shape and the area of the antenna element 14 can be change flexibly in accordance with the shape of the outer surface of the inner case 13.

Further, the antenna element 14 is mounted to the inner case 13 only by inserting the five tongue pieces 142 into the hole portions 134 of the inner case 13 and threadably fitting the antenna element 14 with the male screw through the through hole 141 therebetween. Further, the antenna element 14 is conductive with the helical coil 121 through the joint plate 122. Thus, the antenna element 14 can be mounted on the antenna device 1 without providing a special-purpose supporting member. Replacement work for the antenna element 14 is significantly facilitated. Thus, the manufacture steps of the antenna device 1 and maintenance steps of the antenna element 14 after manufacture are remarkably simplified as compared to an antenna device having a related-art structure.

Further, in the antenna device 1 of this embodiment, the watertight connecting member 16 is embedded in the inner case 13 and the watertight connecting member 16 is used to cause the antenna element 14 and the joint plate 122 to be conductive with each other. Therefore, even when the antenna element 14 is arranged on the outer surface of the inner case 13, the water-tightness of the housing space S of the inner case 13 can be easily ensured.

Further, in this embodiment, the helical coil 121, the base portion of the joint plate 122 conductive with the one end portion of the helical coil 121, and the base portion of the U-shaped piece 123 conductive with the another end portion of the helical coil 121 are molded with the resin to construct the coil element 12. The coil element 12 is formed into a module so that the assembly into the antenna device 1 is enabled only by screwing or mounting the U-shaped piece 123 into the terminal 111. Thus, as compared to this type of related-art antenna devices, assembly steps are simplified to facilitate mass production.

Although an example where the outer terminal 161 of the watertight connecting member 16 and the through hole 141 of the antenna element 14 are connected to each other and the inner terminal 162 of the watertight connecting member 16 and the through hole 122*a* of the joint plate 122 are connected to each other by threadably fitting the male screws has been described in this embodiment, the above-mentioned connections may be achieved by engagement of pin members.

Second Embodiment

In the first embodiment, an example where the single antenna element 14 is provided and each of the helical coil 121 and the coil supporting portion 125 of the coil element 12 is cylindrical has been described. However, the embodiments of the present invention are not limited to the example described above.

In a second embodiment of the present invention, an example where two antenna elements are provided and formation into a module is achieved by forming coils on a board is described. A board on which coils are formed is referred to as "coil board". The coil board is installed upright on the circuit board 11 described in the first embodiment.

Providing the two antenna elements means that electromagnetic waves in different frequency bands can be received.

Figure 8:
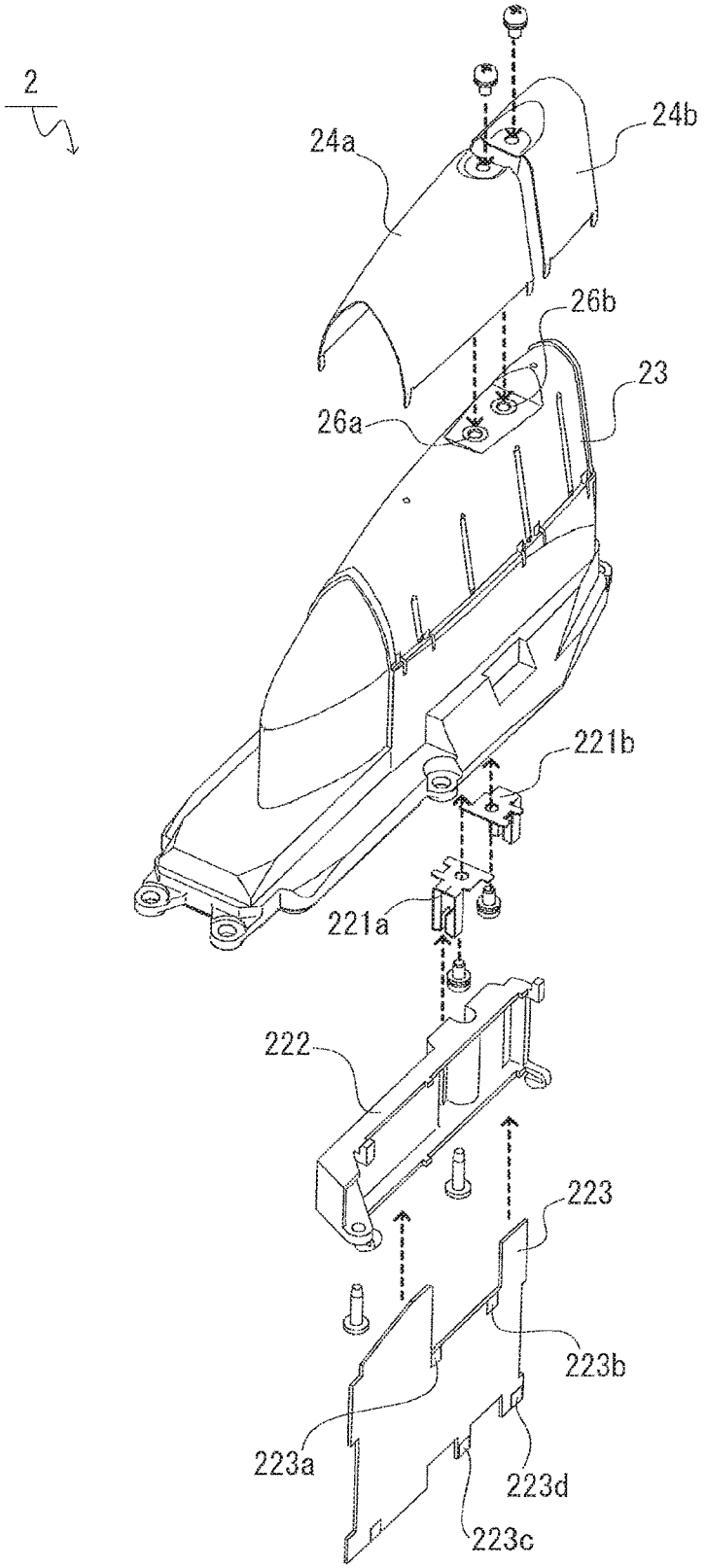
FIG. 8 is a partially exploded perspective view of an antenna device according to a second embodiment of the present invention.

FIG. 8 is an exploded perspective view of an antenna device 2 according to the second embodiment. The antenna device 2 is the same as the antenna device 1 according to the first embodiment in having the double-case structure. Specifically, even in the second embodiment, the outer case 15 described in the first embodiment is used.

With reference to FIG. 8, the antenna device 2 of the second embodiment includes a first antenna element 24*a* and a second antenna element 24*b*. Therefore, two watertight connecting members 26*a* and 26*b* are embedded in an inner case 23. Each of the watertight connecting members 26*a* and 26*b* is the same as the watertight connecting member 16 described in the first embodiment. The first antenna element 24*a* is electrically connected to an outer terminal of the watertight connecting member 26*a*, whereas the second antenna element 24*b* is electrically connected to an outer terminal of the watertight connecting member 26*b*.

An inner terminal of the watertight connecting member 26*a* is electrically connected to a first joint plate 221*a*, whereas an inner terminal of the watertight connecting member 26*b* is electrically connected to the second joint plate 221*b*. The first joint plate 221*a* and the second joint plate 221*b* are mounted to the inner case 23 respectively by male screws.

The antenna device 2 includes a coil board 223 held by a holder 222 so that the holder 222 is fixed to a predetermined portion of an inner wall of the inner case 23. When being fixed to the inner case 23, the coil board 223 is arranged in a direction perpendicular to the circuit board 11. When the holder 222 is fixed to the inner case 23, a first contact point 223*a* that is conductive with the first joint plate 221*a*, a second contact point 223*b* that is conductive with the second joint plate 221*b*, and a third contact point 223*c* and a fourth contact point 223*d* that are conductive with terminals (not shown) (having the same structure as that of the terminal 111 described in the first embodiment) provided on the circuit board side are formed on the coil board 223.

The first contact point 223*a* formed on the coil board 223 is conductive with one end of a first coil (not shown), whereas the third contact point 223*c* is conductive with another end of the first coil. The second contact point 223*b* formed on the coil board 223 is conductive with one end of a second coil (not shown), whereas the fourth contact point 223*d* is conductive with another end of the second coil.

As described above, in the antenna device 2 of the second embodiment, the two antenna elements 24*a* and 24*b* are provided on the outer surface of the single inner case 23. Then, the first antenna element 24*a* and the first coil of the coil board 223 that is installed upright inside the inner case 23 are made conductive with each other and the second antenna element 24*b* and the second coil of the coil board 223 are made conductive with each other while keeping the housing space watertight. Therefore, similarly to the first embodiment, even with the double-case structure, the electromagnetic waves in the plurality of frequency bands can be received by the antenna device 2 without lowering the antenna performance as compared to a case of the single-case structure.

Further, the antenna elements 24*a* and 24*b* and the coil board 223 can be mounted to the inner case 23 only by screwing. Therefore, the manufacture steps can be simplified.

In the first embodiment and the second embodiment, the examples where the antenna element 14 is arranged on the outer surface of the inner case 13 and the antenna elements 24*a* and 24*b* are arranged on the outer surface of the inner case 23 have been described. However, the antenna element may also be provided on an inner wall of the outer case 15. In this case, the watertight connecting member 16 and the antenna element 14, and the watertight connecting members 26*a* and 26*b* and the antenna elements 24*a* and 24*b* only need to be connected by a feeder line.

REFERENCE SIGNS LIST

1, 2 . . . antenna device, 10 . . . base, 11 . . . circuit board, 12 . . . coil element, 13,23 . . . inner case, 14, 24*a*, 24*b* . . . antenna element, 15 . . . outer case, 16,26*a*, 26*b* . . . watertight connecting member, 131 . . . top portion, 132 . . . dent portion, 17 . . . elastic pad, S . . . housing space, 18 . . . connector mechanism

The invention claimed is:

1. An antenna device to be installed on a predetermined portion of a vehicle body, comprising:

an inner case having a three-dimensional shape, configured to form a housing space so as to house an electronic component therein;

an outer case configured to cover the inner case;

a first element provided between an outer surface of the inner case and an inner surface of the outer case, wherein the first element is electrically connected to the electronic component while maintaining water-tightness of the housing space inside the inner case; and an embedded watertight connecting member having an outer terminal exposed on the outer surface of the inner case and an inner terminal exposed on the inner surface of the inner case, the inner terminal being conductive with the outer terminal while maintaining the water-tightness of the housing space inside the inner case, wherein the outer terminal is configured to also serve as a mounting mechanism for the first element.

2. An antenna device according to claim 1, wherein a shape of the outer surface of the inner case on which the first element is provided is approximately similar to a shape of the inner surface of the outer case, and the first element is formed in an approximately planar shape along the shape of the outer surface of the inner case or the shape of the inner surface of the outer case.

3. An antenna device according to claim 1, wherein the watertight connecting member includes a conductive member having a cylindrical shape with a partition, the conductive member having a common partition portion and a pair of opening portions being open in directions opposite to each other, one of the pair of opening portions being the outer terminal and another of the pair of opening portions being the inner terminal, and the partition portion is configured to separate the housing space and a space in periphery of the outer surface of the inner case from each other.

4. An antenna device according to claim 1, wherein at least one of the outer terminal and the inner terminal has a structure of engaging a screw or a pin member.

5. An antenna device according to claim 1, wherein the electronic component includes a second element formed into a module, and the inner terminal is configured to also serve as a mounting mechanism for one end portion of the second element.

6. An antenna device according to claim 2, wherein first element is in an elastic contact with the inner case.

7. An antenna device according to claim 6, further comprising:

a plurality of tongue pieces projecting downward from an edge of the first element, wherein the inner case includes a projecting portion and a hole portion for housing the tongue pieces in a predetermined position, an inner case of the first element is in a contact with the projecting portion and the tongue pieces are housed in the hole portion, thereby the first element is in the elastic contact with the inner case.

8. An antenna device according to claim 1, wherein:

a dent portion is provided in the vicinity of a top portion of the inner case, and another dent portion is provided in the vicinity of a top portion of the first element, and the outer terminal is exposed to the dent portion of the inner case, and the outer terminal is in contact the another dent portion of the first element.

9. An antenna device according to claim 3, wherein an outer peripheral portion of the common partition portion is a ridge having a larger diameter than that of the pair of opening portions.

10. An antenna device according to claim 5, wherein the inner terminal and the one end portion of the second element are electrically connected through a joint plate having an elongated plate-like shape.

11. An antenna device to be installed on a predetermined portion of a vehicle body, comprising:

an inner case having a three-dimensional shape, configured to form a housing space so as to house an electronic component therein;

an outer case configured to cover the inner case; and a first element and a second element which, in combination, are configured to receive at least FM band by electrically connecting the first element and the second element each other, wherein, the first element is provided between an outer surface of the inner case and an inner surface of the outer case;

the second element is housed in the housing space; and the first element is electrically connected to the electronic component through the second element while maintaining water-tightness of the housing space inside the inner case.

12. An antenna device according to claim 5, wherein:

the first element is a conductive member formed in an approximately planar shape; and the second element is a coil element.

13. An antenna device according to claim 11, wherein:

the first element is a conductive member formed in an approximately planar shape; and the second element is a coil element.

14. An antenna device to be installed on a predetermined portion of a vehicle body, comprising:

an inner case having a three-dimensional shape, configured to form a housing space so as to house an electronic component therein;

an outer case configured to cover the inner case;

a first element provided between an outer surface of the inner case and an inner surface of the outer case, wherein the first element is electrically connected to the electronic component while maintaining water-tightness of the housing space inside the inner case; and an embedded watertight connecting member having an outer terminal exposed on the outer surface of the inner case and an inner terminal exposed on the inner surface of the inner case, the inner terminal being conductive with the outer terminal while maintaining the water-tightness of the housing space inside the inner case, wherein the electronic component includes a second element formed into a module, and the inner terminal is configured to also serve as a mounting mechanism for one end portion of the second element.

15. An antenna device according to claim 14, wherein the inner terminal and the one end portion of the second element are electrically connected through a joint plate having an elongated plate-like shape.

16. An antenna device according to claim 14, wherein:

the first element is a conductive member formed in an approximately planar shape; and the second element is a coil element.

17. An antenna device according to claim 14, wherein the outer terminal is configured to also serve as a mounting mechanism for the first element.

* * * * *